US009829824B2

(12) United States Patent
Uemura et al.

(10) Patent No.: US 9,829,824 B2
(45) Date of Patent: Nov. 28, 2017

(54) OPTICAL WRITING DEVICE AND IMAGE FORMING DEVICE

(71) Applicant: KONICA MINOLTA, INC., Chiyoda-ku, Tokyo (JP)

(72) Inventors: Takaki Uemura, Seto (JP); So Yano, Ibaraki (JP); Masayuki Iijima, Okazaki (JP); Takahiro Matsuo, Toyokawa (JP); Akira Taniyama, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/352,884

(22) Filed: Nov. 16, 2016

(65) Prior Publication Data

US 2017/0168413 A1 Jun. 15, 2017

(30) Foreign Application Priority Data

Dec. 15, 2015 (JP) ..... 2015-244360

(51) Int. Cl.
*G03G 15/043* (2006.01)
*G03G 15/04* (2006.01)

(52) U.S. Cl.
CPC ..... *G03G 15/043* (2013.01); *G03G 15/04054* (2013.01)

(58) Field of Classification Search
CPC ..... G03G 15/04054
See application file for complete search history.

(56) References Cited

U.S. PATENT DOCUMENTS

2015/0239258 A1 8/2015 Yano et al.

FOREIGN PATENT DOCUMENTS

| | | | | |
|---|---|---|---|---|
| JP | 09314908 A | | 12/1997 | |
| JP | 11138890 A | * | 5/1999 | ..... G06K 15/1247 |
| JP | 2002144634 A | | 5/2002 | |
| JP | 2008252776 A | | 10/2008 | |
| JP | 2014177088 A | * | 9/2014 | |

OTHER PUBLICATIONS

Extended European Search Report (EESR) dated Mar. 2, 2017, issued in counterpart European Application No. 16201106.8.

* cited by examiner

*Primary Examiner* — Victor Verbitsky
(74) *Attorney, Agent, or Firm* — Holz, Holtz & Volek PC

(57) ABSTRACT

An optical writing device including: a current-driven light-emitting element; a thin film transistor configured to supply the light-emitting element with a drive current based on a luminance signal to put the light-emitting element in an on state; and a controller configured to, for each line of an image page, correct a first value of the luminance signal to yield a second value of the luminance signal, and to supply the thin film transistor with the luminance signal at the second value. The second value compensates for a light amount fluctuation of the light-emitting element that is dependent upon an emission/non-emission history, from an initial line of the image page to the line, of a first continuous period where the light-emitting element is kept in the on state and a second continuous period where the light-emitting period is kept in an off state.

11 Claims, 16 Drawing Sheets

FIG. 11A

Continuous on state duration table

| OLED | Continuous on state duration |
|---|---|
| #1 | 0 |
| #2 | 10 |
| ... | ... |
| #15,000 | 0 |

FIG. 11C

Degradation level table

| Cumulative on state duration | Degradation level |
|---|---|
| 0 | 1 |
| 10,000 | 0.98 |
| ... | ... |
| 1,000,000 | 0.37 |

FIG. 11B

Cumulative on state duration table

| OLED | Cumulative on state duration |
|---|---|
| #1 | 25,113 |
| #2 | 10,078 |
| ... | ... |
| #15,000 | 239 |

FIG. 11D

Target light amount table

| OLED | Target light amount |
|---|---|
| #1 | 190 |
| #2 | 280 |
| ... | ... |
| #15,000 | 210 |

FIG. 11E

Input value table

| Continuous on state duration | Degradation level | Surrounding temperature | Target light amount | Luminance signal |
|---|---|---|---|---|
| 0 | 1 | 10 | 100 | 5.0 |
| 0 | 1 | 10 | 110 | 5.1 |
| ... | ... | ... | ... | ... |
| 30,000 | 0.37 | 70 | 400 | 8.4 |

FIG. 14A

Continuous pixel count table

| OLED | Continuous pixel count |
|---|---|
| #1 | -55 |
| #2 | 10 |
| ... | ... |
| #15,000 | -193 |

FIG. 14B

State index value table

| OLED | State index value K | Initial value $K_0$ |
|---|---|---|
| #1 | 0.5 | 0 |
| #2 | 0.4 | 0.8 |
| ... | ... | ... |
| #15,000 | 0 | 0 |

FIG. 14C

Fluctuation amount table

| Continuous pixel count | On state fluctuation amount Kon | Off state fluctuation amount Koff |
|---|---|---|
| 1 | 0.5 | 0.4 |
| 2 | 0.6 | 0.5 |
| 3 | 0.69 | 0.55 |
| ... | ... | ... |
| 30,000 | 0.9 | 0.8 |

FIG. 14D

Input value table

| State index value K | Degradation level | Surrounding temperature | Target light amount | Luminance signal |
|---|---|---|---|---|
| 0 | 1 | 10 | 100 | 5.0 |
| 0 | 1 | 10 | 110 | 5.1 |
| ... | ... | ... | ... | ... |
| 0.9 | 0.37 | 70 | 400 | 8.4 |

During on state

During off state

Example of operation

FIG. 18A

Reference input value table

| Target light amount | Luminance signal |
|---|---|
| 100 | 5.0 |
| 110 | 5.1 |
| ... | ... |
| 390 | 8.3 |
| 400 | 8.4 |

FIG. 18B

Coefficient table

| Continuous on state duration | Surrounding temperature | Degradation level | Coefficient |
|---|---|---|---|
| 0 | 10 | 1.0 | 0.90 |
| 0 | 10 | 1.1 | 0.91 |
| ... | ... | ... | ... |
| 30,000 | 70 | 1.4 | 1.80 |
| 30,000 | 70 | 1.5 | 1.90 |

OPTICAL WRITING DEVICE AND IMAGE FORMING DEVICE

CROSS-REFERENCE TO RELATED APPLICATIONS

This application is based on application No. 2015-244360 filed in Japan, the contents of which are hereby incorporated by reference.

BACKGROUND OF THE INVENTION (1) Technical Field

The present disclosure is related to optical writing devices and image forming devices. In particular, the present disclosure is related to a technology of suppressing a fluctuation in a light amount emitted by a light-emitting element that otherwise occurs when a voltage droop occurs in a thin film transistor (TFT) that supplies the light-emitting element with a drive current.

(2) Related Art

Recently, in order to achieve a reduction in image forming device size and cost, development is in progress of organic light-emitting diode (OLED) print heads (PHs), which are optical writing devices including OLEDs arranged in line(s) as light sources. OLED-PHs contribute to reduction in image forming device size and cost because in an OLED-PH, light-emitting elements (OLEDs) and drive circuits (TFTs) are disposed on the same substrate.

In connection with this, TFTs containing low-temperature polycrystalline silicon (LTPS) (such TFTs referred to in the following as LTPS-TFTs) are known. In an LTPS-TFT, when a voltage greater than a threshold voltage Vth is continuously applied between the source and gate electrodes (the voltage between the source and gate electrodes of an LTPS-TFT is referred to in the following as a voltage Vgs), a so-called voltage droop occurs. That is, in an LTPS-TFT, the longer a voltage greater than the voltage Vth continues to be applied between the source and gate electrodes, the smaller the current between the source and drain electrodes becomes.

Thus, when LTPS-TFTs are used as TFTs in an OLED-PH, a light amount that an OLED emits decreases as the amount of time increases for which the OLED is kept in on state, as illustrated in portion (a) of FIG. 12. This produces a sub scanning direction density unevenness. For example, when a solid image is being formed, the density of the solid image decreases as image forming progresses in the sub scanning direction, as illustrated in portion (b) of FIG. 12.

As an example of a countermeasure against this issue, Japanese Patent Application Publication No. 2002-144634 (referred to as "Patent Literature 1" in the following) discloses a technology of overcoming such density unevenness by measuring OLED light amounts by providing light amount sensors, one for each OLED, and performing feedback control based on the OLED light amounts.

However, the conventional technology disclosed in Patent Literature 1 requires providing a plurality of sensors, one for each OLED, and thus inevitably leads to an increase in OLED-PH size and cost.

SUMMARY OF THE INVENTION

In view of such technical problems, the present disclosure provides an optical writing device that includes a light-emitting element and a TFT and that suppresses a sub scanning direction density unevenness that otherwise occurs when the light-emitting element is kept in on state, and an image forming device including such an optical writing device.

One aspect of the present disclosure is an optical writing device optical writing device, upon acquiring data for one image page, performing light-exposure of a photoreceptor based on the data to form an electrostatic latent image corresponding to the image page on the photoreceptor, the light-exposure performed line-by-line of the image page, the optical writing device including: a current-driven light-emitting element; a thin film transistor configured to supply the light-emitting element with a drive current based on a luminance signal to put the light-emitting element in an on state; and a controller configured to, for each line of the image page, correct a first value of the luminance signal to yield a second value of the luminance signal, and to supply the thin film transistor with the luminance signal at the second value, wherein the second value compensates for a light amount fluctuation of the light-emitting element that is dependent upon an emission/non-emission history, from an initial line of the image page to the line, of a first continuous period where the light-emitting element is kept in the on state and a second continuous period where the light-emitting period is kept in an off state.

BRIEF DESCRIPTION OF THE DRAWINGS

These and other objects, advantages and features of the technology pertaining to the present disclosure will become apparent from the following description thereof taken in conjunction with the accompanying drawings, which illustrate specific embodiments of the technology pertaining to the present disclosure.

In the drawings:

FIG. 11A shows a continuous on state duration table, used by the controller 101 for controlling luminance signals;

FIG. 11B shows a cumulative on state duration table;

FIG. 11C shows a degradation level table;

FIG. 11D shows a target light amount table;

FIG. 11E shows an input value table;

FIG. 14A shows a continuous pixel count table, used by the controller 101 for controlling luminance signals;

FIG. 14B shows a state index value table;

FIG. 14C shows a fluctuation amount table;

FIG. 14D shows an input value table;

FIG. 18A shows a reference input value table, used by the controller 101 for controlling luminance signals; and FIG. 18B shows a coefficient table.

DESCRIPTION OF PREFERRED EMBODIMENTS

The following embodiments describe the optical writing device and the image forming device pertaining to the present disclosure, with reference to the accompanying drawings. However, the scope of the technology pertaining to the present disclosure is not limited to the illustrated examples.

[1] First Embodiment

The following describes an image forming device pertaining to a first embodiment of the technology pertaining to the present disclosure. The image forming device pertaining to the present embodiment is characterized for measuring the number of image lines for which an OLED is kept in on state, and correcting a luminance signal for the OLED to ensure that the OLED emits a desirable light amount.

(1-) Structure of Image Forming Device

The following describes main components of the image forming device pertaining to the present embodiment.

Figure 1:
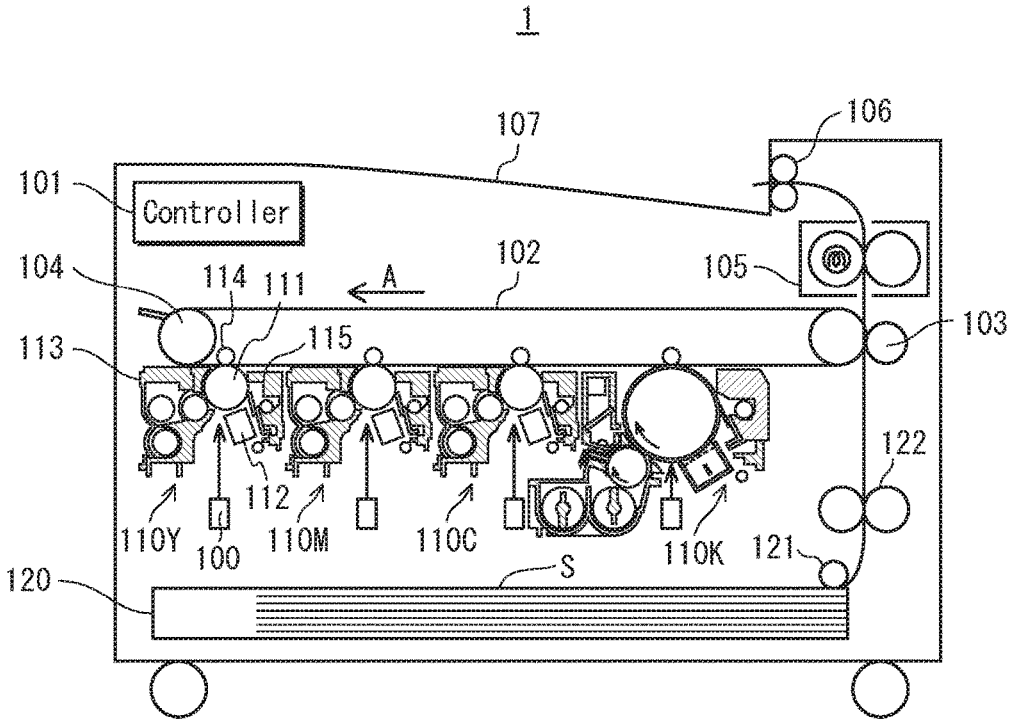
FIG. 1 illustrates main components of an image forming device pertaining to a first embodiment.

As illustrated in FIG. 1, an image forming device 1 pertaining to the first embodiment is a color printer having the so-called tandem system. The image forming device 1 includes a controller 101 and image forming stations 101Y, 101M, 101C, and 101K. The image forming stations 101Y, 101 M, 101C, 101K are controlled by the controller 101 and each form a toner image of a corresponding one of the colors yellow (Y), magenta (M), cyan (C), and black (K).

The following describes the operation of the image forming stations 101Y, 101M, 101C, 101K, taking the image forming station 110Y as an example. The image forming station 110Y includes a photoreceptor drum 111 and a charger 112 that uniformly charges the outer circumferential surface of the photoreceptor drum 111. The image forming station 110Y further includes an optical writing device 100. The optical writing device 100 exposes the outer circumferential surface of the photoreceptor drum 111 to light, and thereby forms an electrostatic latent image on the outer circumferential surface of the photoreceptor drum 111.

The image forming station 110Y further includes a developer 113. The developer 113 supplies the outer circumferential surface of the photoreceptor drum 111 with toner, to develop the electrostatic latent image and form a yellow toner image on the outer circumferential surface of the photoreceptor drum 111. The image forming station 110Y further includes a primary transfer roller 114. The primary transfer roller 114 performs primary transfer by electrostatically transferring the toner image on the outer circumferential surface of the photoreceptor drum 110 onto an outer circumferential surface of an intermediate transfer belt 102 of the image forming device 1. The image forming station 110Y further includes a cleaner 115. The cleaner 115 removes any toner remaining on the outer circumferential surface of the photoreceptor drum 110 after completion of the primary transfer, and discards the excess toner.

The intermediate transfer belt 102 is suspended across a passive roller 104 of the image forming device 1 and one of two secondary transfer rollers forming a secondary transfer roller pair 103 of the image forming device 1. The intermediate transfer belt 102 carries toner images and circulates in the direction indicated by arrow A in FIG. 1.

Each of the image forming stations 110M, 110C, and 110K perform primary transfer as described above. This results in toner images of the colors magenta, cyan, and black also being transferred onto the outer circumferential surface of the intermediate transfer belt 102. Here, since the primary transfer timing of the toner images of the colors magenta, cyan, and black are controlled so that toner images of all colors overlap one another on the outer circumferential surface of the intermediate transfer belt 102, a color toner image is formed on the outer circumferential surface of the intermediate transfer belt 102. The intermediate transfer belt 102 carries this color toner image to the secondary transfer roller pair 103.

The image forming device 1 further includes a paper cassette 120 accommodating recording sheets S and a pickup roller 121 that picks up and feeds the recording sheets S in the paper cassette 120 one by one. A recording sheet S that is picked up by the pickup roller 121 travels to a timing roller 122 of the image forming device 1, and comes to a temporary halt when arriving at the timing roller 122. Then, the recording sheet S travels to the secondary transfer roller pair 103 to arrive at the secondary roller pair 103 when the color toner image on the intermediate transfer belt 102 arrives at the secondary transfer roller pair 103.

The secondary transfer roller pair 103 performs secondary transfer by electrostatically transferring the color toner image on the intermediate transfer belt 102 onto the recording sheet S. The color toner images on the recording sheet S then receive thermal fixing at a fixing device 105 of the image forming device 1, before being ejected onto an eject tray 107 of the image forming device 1 by an eject roller 106 of the image forming device 1.

Note that the image forming device 1 further includes an operation panel 910 (not illustrated in FIG. 1 but illustrated in FIG. 9) that is connected to the controller 101. The operation panel 910 presents information to users of the image forming device 1, and receives input of instructions from users of the image forming device 1.

(1-2) Structure of Optical Writing Device 100

The following describes the structure of the optical writing device 100.

(1-2-1) Overall Structure

Figure 2:
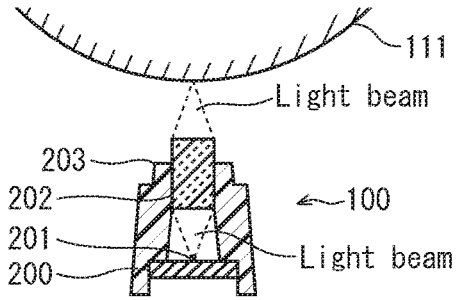
FIG. 2 illustrates main components of an optical writing device 100.

As illustrated in FIG. 2, the optical writing device 100 includes an OLED panel 200, a rod lens array 202, and a holder 203. The OLED panel 200 and the rod lens array 202 are accommodated inside the holder 203. Further, the OLED panel 200 includes a plurality of OLEDs 201 arranged in line. Light beams L emitted by each OLED 201 are collected onto the outer circumferential surface of the photosensitive drum 111 included in the same image forming system as the optical writing device 100 by the rod lens array 202. The rod lens array 202 is an optical device composed of a plurality of rod lenses. For example, a SELFOC lens array (SLA; SELFOC is a registered trademark of Nippon Sheet Glass Co. LTD.) may be used as the rod lens array 202, or a micro lens array (MLA) may be used as the rod lens array 202.

Here, it should be noted that the OLEDs 201 are located at various positions relative to the rod lenses of the rod lens array 202. Thus, the rod lens array 202 cannot collect the same amount of light from every OLED 201. This means that if all OLEDs 201 are caused to emit the same light amount, the light amount reaching the outer circumferential surface of the photosensitive drum 111 would vary among the OLEDs 201. In order to prevent such variance among the OLEDs 201 in terms of the light amount reaching the photosensitive drum 111, a later-described target light amount is set for each OLED 201 in the present embodiment.

(1-2-2) Overall Structure of OLED Panel 200

Figure 3:
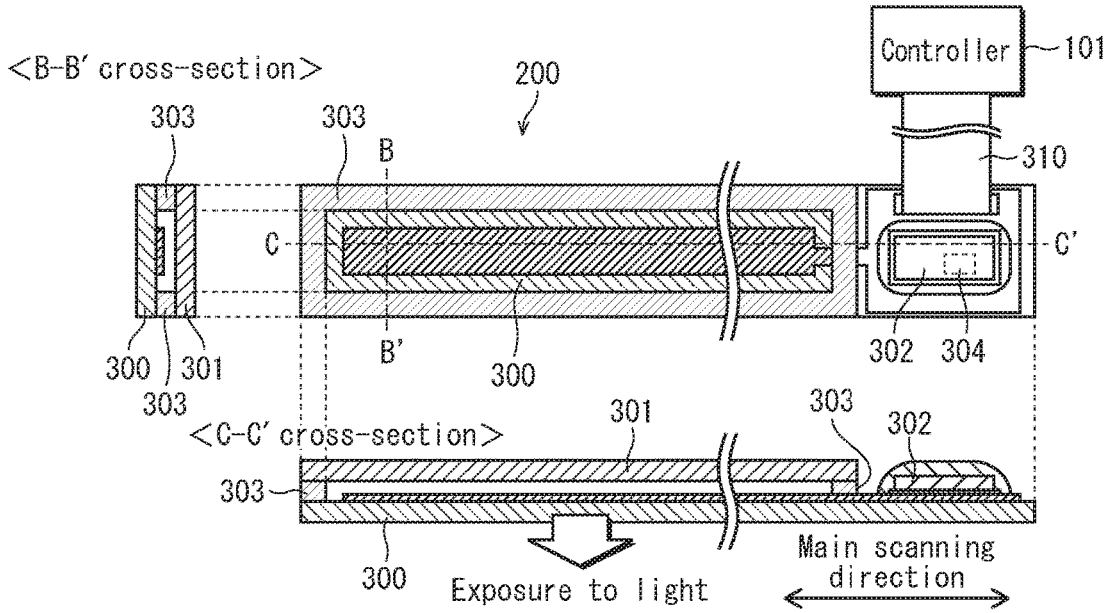
FIG. 3 includes a schematic plan view of an OLED panel 200 and cross-sectional views of the OLED panel 200 taken along lines A-A' and C-C'.

FIG. 3 includes a schematic plan view of the OLED panel 200 and cross-sectional views of the OLED panel 200 taken along lines A-A' and C-C'. The schematic plan view portion of FIG. 3 illustrates the OLED panel 200 in a state where a later-described sealing plate 301 thereof has been removed.

As illustrated in FIG. 3, the OLED panel 200 includes a TFT substrate 300, the sealing plate 301, and a spacer frame 303. The TFT substrate 300 includes a driver integrated circuit (IC) 302 The TFT substrate 300 includes fifteen thousand (15,000) OLEDs 201 arrayed along a main scanning direction. The OLEDs 201 are arrayed such that light collection points of adjacent ones of the OLEDs 201 are separated by a pitch of 21.2 μm, to achieve a resolution of one thousand and two hundred (1,200) dots per inch (dpi). A light-collection point of an OLED 201 is a point on the outer circumferential surface of the photoreceptor drum 111 where light from the OLED 201 arrives, after being collected at the rod lens array 202.

The TFT substrate 300 includes a plurality of LTPS-TFTs.

The sealing plate 301 is disposed above a surface of the TFT substrate 300 on which the OLEDs 201 are disposed, with the spacer frame 303 placed between the sealing plate 301 and the TFT substrate 300. This structure enables sealing the OLEDs 201 and the like to be prevented from coming into contact with outside air. Further, dry nitrogen or the like is disposed between the sealing plate 301 and the TFT substrate 300. In addition, a moisture sorption agent may also be disposed between the sealing plate 301 and the TFT substrate 300. Further, the sealing plate 301 may be made of glass or a material other than glass.

The driver IC 302 is disposed on the TFT substrate 300, outside the region of the TFT substrate 300 where sealing is provided as described above. The driver IC 302 receives image data from the controller 101, via a flexible flat cable (FFC) 310. The driver IC 302 converts the image data so received into luminance signals, and outputs the luminance signals. Note that the light amounts that the OLEDs 201 emit are controlled by the OLEDs 201 being supplied with drive currents based on these luminance signals. The luminance signals may be current signals or voltage signals.

The driver IC 302 includes a built-in temperature sensor 304. The temperature sensor 304 detects the temperature inside the driver IC 302. Since the temperature inside the driver IC 302 and the temperature of the OLEDs 201 are correlated, the temperature inside the driver IC 302 is used as an indicator of the surrounding temperature of the OLEDs 201.

As such, the optical writing device 100 is an OLED print head. OLED print heads are typically lower in cost than LED print heads, for OLEDs and TFTs being disposed on the same substrate, whereas in typical LED print heads, a light-emitting portion (an LED array) and a control circuit portion (drive IC, or the like) are disposed on separate substrates.

(1-2-3) Structure of TFT Substrate 300

The OLEDs 201 have a light amount-temperature characteristic such that luminous efficacy of each OLED 201 is affected by the surrounding temperature of the OLEDs 201. Due to this, a change in surrounding temperature of the OLEDs 201 brings about a change in density of printed images. Further, the OLEDs 201 have a degradation characteristic such that the light amount an OLED 201 is capable of emitting decreases as the total amount of time for which the OLED 201 has been in on state (referred to in the following as a cumulative on state duration) increases. The OLEDs 201 include OLEDs having different cumulative on state durations, due to not all OLEDs 201 performing light-emission for the same amount of time based on the same image data. Accordingly, the OLEDs 201 include OLEDs having different degradation levels and thus emitting different light amounts.

In order to overcome such technical problems and produce printed images with appropriate density and high image quality, it is necessary to separately control the light amounts of the OLEDs 201. This is achieved by the driver IC 302 using digital-to-analog converters (DACs) and writing luminance signals separately generated for the respective OLEDs 201 to drive circuits corresponding to the OLEDs 201.

Further, the present embodiment achieves relatively small circuit scale due to each of the DACs being shared by a plurality of OLEDs 201, and due to the active drive method being employed, where the DACs perform the writing of luminance signals by switching from one to another of a plurality of OLEDs 201. Note that with the active drive method, luminance signals that the DACs write are retained until writing of subsequent luminance signals is performed after elapse of one main scanning period (period Hsync). This means that, for example, when a luminance signal is received, an OLED is put in on state for approximately one main scanning period.

Figure 4:
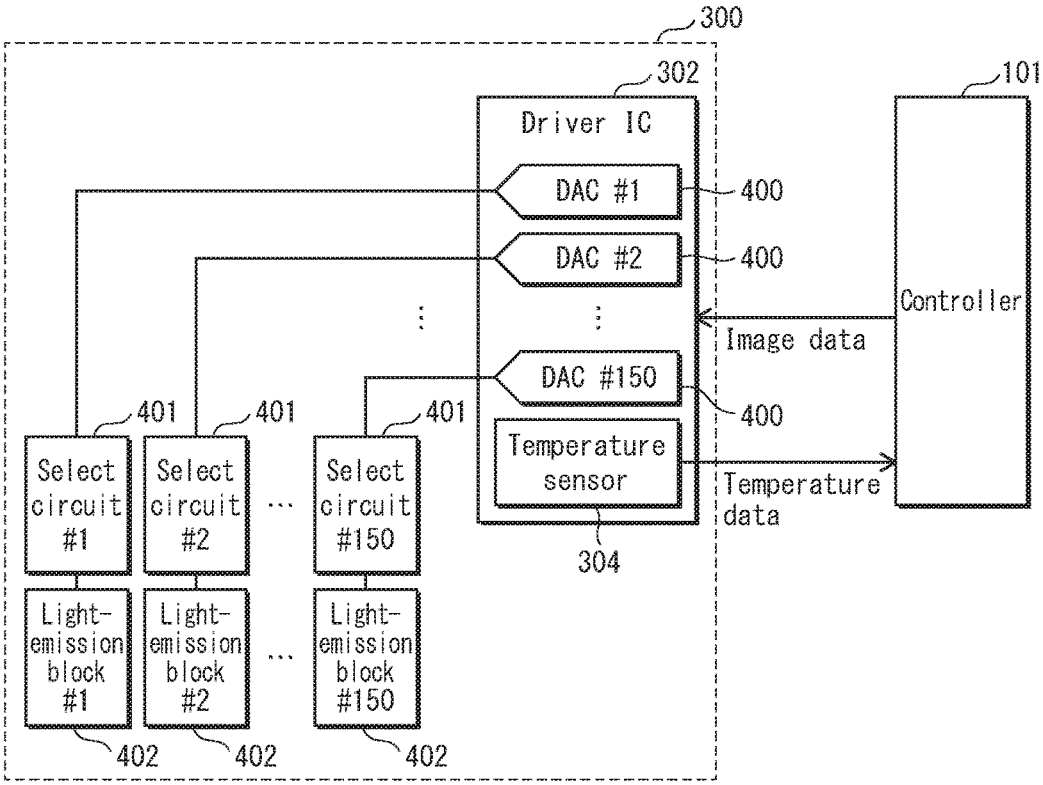
FIG. 4 illustrates main functional blocks of a TFT substrate 300.

As illustrated in FIG. 4, the TFT substrate 300 has one hundred and fifty (150) light-emission blocks 402. Each of the light-emission blocks includes one hundred (100) among the fifteen thousand (15,000) OLEDs 201. Further, the driver IC 302 includes one hundred and fifty (150) built-in DACs 400 corresponding one-to-one with the one hundred and fifty (150) light-emission blocks 402. Further, the temperature detected by the built-in temperature sensor 304 of the driver IC 302 is referred to by the controller 101.

The driver IC 302, upon receiving image data from the controller 101, distributes the image data among the DACs 400. The distribution is performed so that each DAC 400 receives data for one hundred (100) pixels, per main scanning period. The TFT substrate 300 includes a plurality of select circuits 401, each disposed along a circuit connecting a DAC 400 and a corresponding light-emission block 402. Each DAC 400, upon receiving image data distributed from the driver IC 302, converts the image data into luminance signals for the one hundred (100) OLEDs 201 belonging to the corresponding light-emission block 402, and outputs the luminance signals to the OLEDs 201 one after another.

Figure 5:
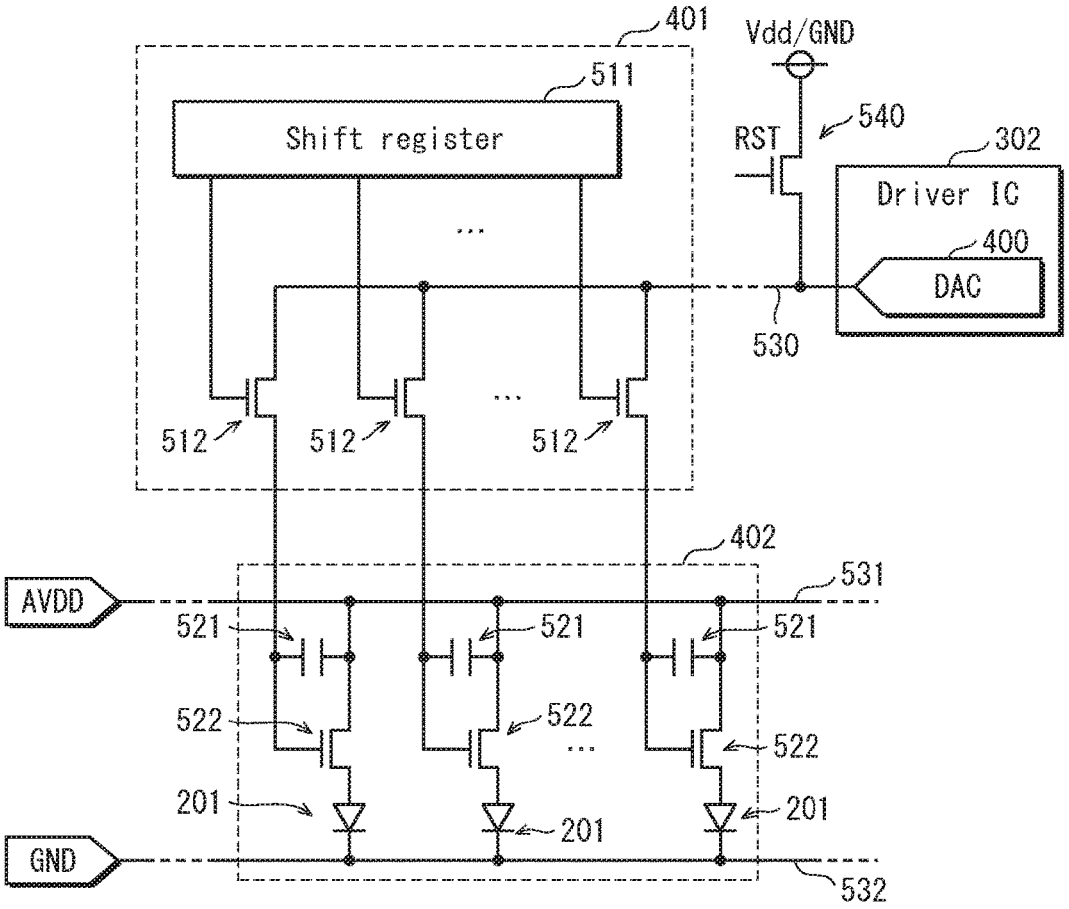
FIG. 5 is a circuit diagram illustrating one pair of a select circuit 401 and a light-emission block 402.

FIG. 5 is a circuit diagram illustrating one pair of a select circuit 401 and a light-emission block 402. As illustrated in FIG. 5, the light-emission block 402 is composed of one hundred (100) pixel circuits. Each pixel circuit includes a capacitor 521, a drive TFT 522, and one OLED 201. Meanwhile, the select circuit 401 includes a shift register 511 and one hundred (100) select TFTs 512.

The shift register 511 is connected to the gate terminals of the one hundred (100) select TFTs 512, and turns on the select TFTs 512 one after another. The source terminals of the select TFTs 512 are connected to the DAC 400 via a write wire 530. The drain terminals of the select TFTs 512 are each connected to the first terminal of a corresponding capacitor 521 and the gate terminal of a corresponding drive TFT 522.

Each luminance signal from the DAC 400 is input to the first terminal of a capacitor 521 (i.e., the capacitor 521 is charged) with a corresponding select TFT 512 turned on by the shift register 511, and the capacitor 521 holds the luminance signal therein until when it is reset.

The first terminal of each capacitor 521 is also connected to the gate terminal of the corresponding drive TFT 522. The second terminal of each capacitor 521 is connected to the source electrode of the corresponding drive TFT 522 and a power wire 531.

The drain electrode of each drive TFT 522 is connected to the anode terminal of a corresponding OLED 201. Thus, each drive TFT 522 forms a series circuit with a corresponding OLED 201. The cathode terminal of each OLED 201 is connected to a ground wire 532. The power wire 531 is connected to a voltage source AVDD, and the ground wire 532 is connected to a ground terminal GND.

The voltage source AVDD supplies drive currents to the OLEDs 201. Specifically, each OLED 201 receives, as a drive current, a drain current from a corresponding drive TFT 522. The voltage of the drain current is dependent upon the voltage Vgs between the source and gate electrodes of the drive TFT 522, which corresponds to the voltage between the first and second terminals of a corresponding capacitor 521. Needless to say, the higher the voltage Vgs, the greater the drive current that the drive TFT 522 supplies to a corresponding OLED 201 and the greater the light amount that the corresponding OLED 521 emits.

For example, when a capacitor 521 receives a luminance signal with a value higher than a predetermined threshold value Vth, a corresponding drive TFT 522 turns on and a corresponding OLED 201 is put in on state to emit a light amount corresponding to the drive current. Meanwhile, when a capacitor 521 receives a luminance signal with a value lower than the predetermined threshold value Vth, a corresponding drive TFT 522 turns off and a corresponding OLED 201 is put in off state. As such, light amounts that the OLEDs 201 emit can be controlled by changing the luminance signals that the DACs 400 output.

Further, the write wire 530 is connected to a reset circuit 540. Turning on the reset circuit 540 results in the voltage across the wiring from the DAC 400 to each select TFT 512 being reset (i.e., the voltage being initialized to a predetermined voltage). Note that the reset circuit 540, instead of being provided as a separate circuit as illustrated in FIG. 5, may be provided as a built-in circuit of the driver IC 302.

Figure 6:
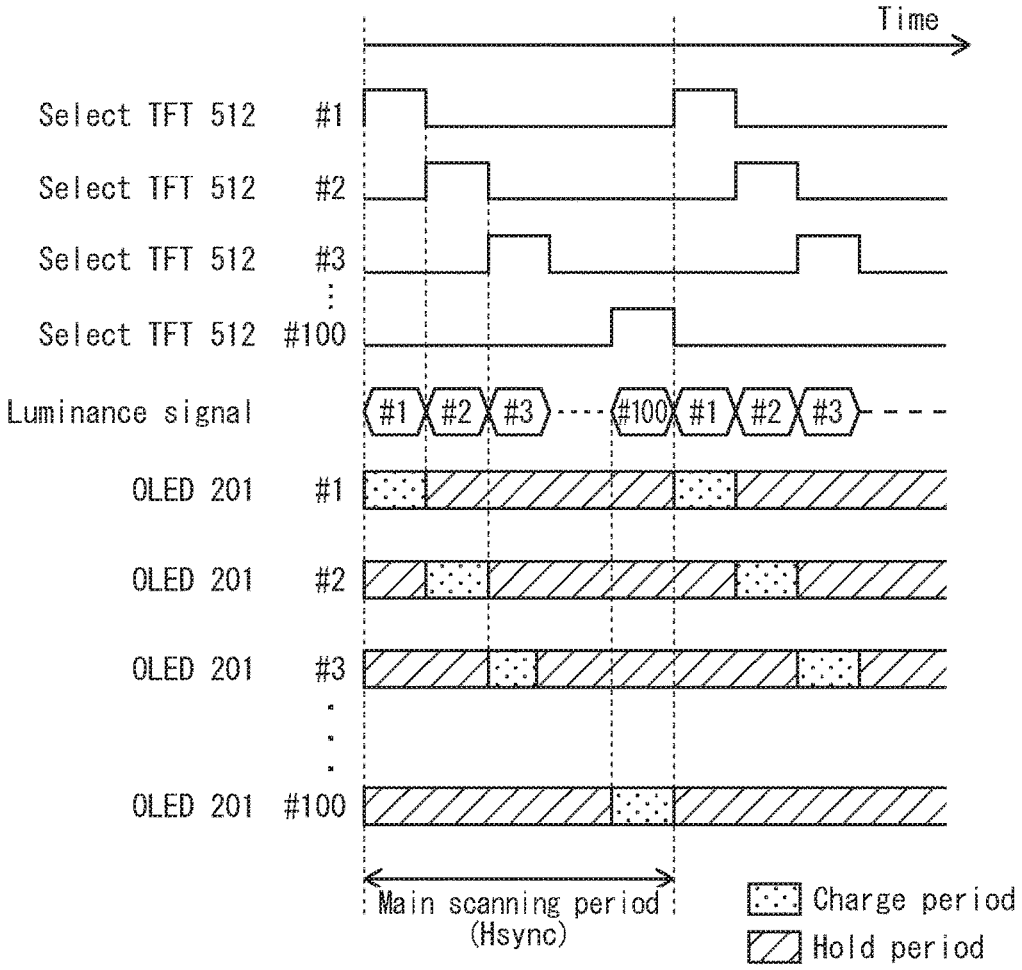
FIG. 6 is a timing chart referred to in explanation of an active drive method.

This circuit structure achieves writing luminance signals as described in the following. As illustrated in FIG. 6, when the shift register 511 turns on select TFT 512 #1, a luminance signal from the DAC 400 is input to the corresponding capacitor 521. The period while the select TFT 512 #1 is on corresponds to a charge period of the capacitor 521.

Subsequently, when the shift register 511 turns off select TFT 512 #1, a drive current corresponding to the voltage across the corresponding capacitor 521 is supplied to the corresponding OLED 201 #1 and the OLED 201 #1 is put in on state. Thus, at the point when the select TFT 512 #1 is turned off, a hold period of the capacitor 521 commences.

At the same time as the shift register 511 turns off select TFT 512 #1, the shift register 511 turns on select TFT 512 #2, which results in a luminance signal being input to the capacitor 521 corresponding to the select TFT 512 #2. The operations described above are repeatedly performed until the operation for select TFT 512 #100 is completed. Further, when the operation for select TFT 512 #100 is completed, the operations are repeated once again from the operation for select TFT 512 #1.

Note that the present embodiment provides description based on an example where the drive TFTs 522 are p-channel TFTs. Needless to say, the drive TFTs 522 may however be n-channel TFTs. Further, each of the write wire 530, the power wire 531, and the ground wire 532 is a thin film wire.

(1-3) Control of Luminance Signals

The following describes how the controller 101 controls the luminance signals output from the driver IC 302.

Each drive TFT 522 is an LTPS-TFT. Due to this, when the same luminance signal is continuously input to a drive TFT 522 to keep a corresponding OLED 201 in on state, the amount of drive current that the drive TFT 522 supplies to the OLED 201 decreases and the light amount that the OLED 201 actually emits decreases. The present embodiment, in order to prevent such decrease in light amount that an OLED 201 emits, the controller 101 controls the luminance signal supplied to the drive TFT 522 such that the amount of drive current supplied to the OLED 201 increases as the amount of time for which the OLED 201 is kept in on state (i.e., a continuous on state duration) increases. Thus, the present embodiment prevents a decrease in density of an image that is formed.

Figure 7:
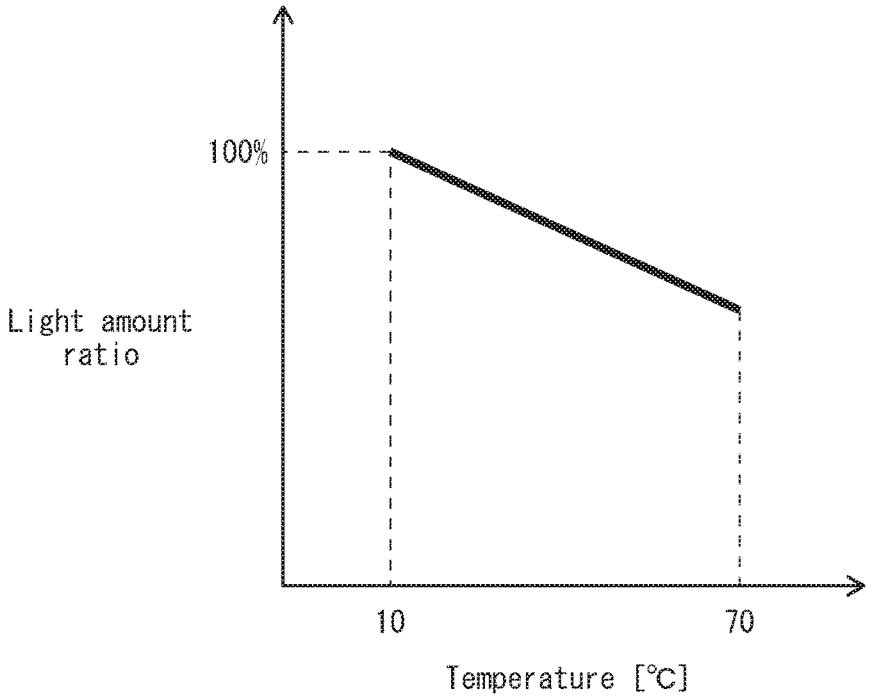
FIG. 7 is a graph illustrating temperature characteristics of an OLED 201.
Figure 8:
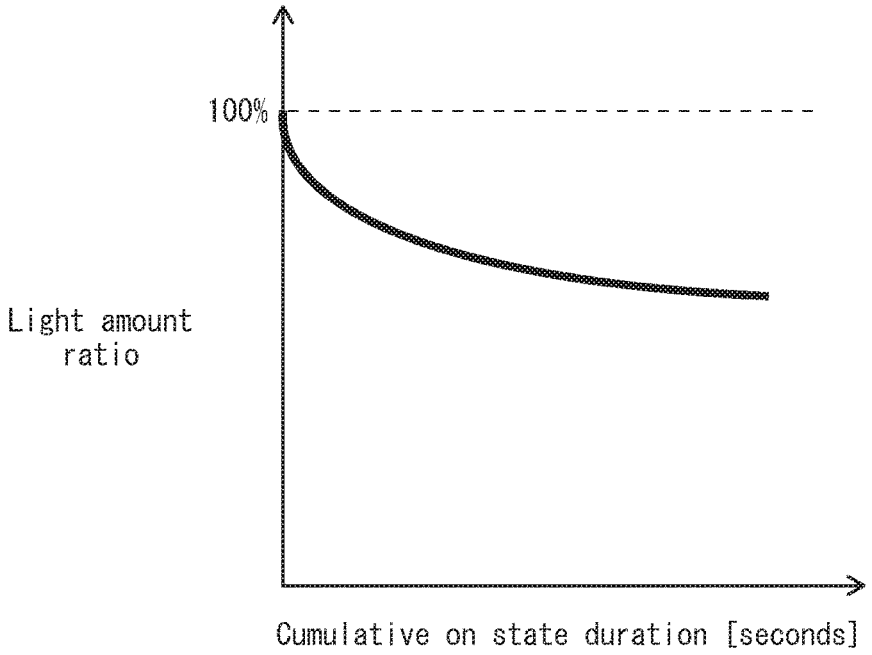
FIG. 8 is a graph illustrating degradation characteristics of the OLED 201.

Note that the controller 101, by controlling the luminance signal, not only prevents the above-described decrease in light amount occurring when an OLED 201 is kept in on state, but also prevents, for example, (i) a fluctuation in light amount occurring when surrounding temperature changes (illustrated in FIG. 7, where illustration is provided of a light amount ratio relative to a light amount at 10 degrees Celsius) and (ii) a fluctuation in light amount occurring when the OLED 201 undergoes degradation over time (illustrated in FIG. 8, where illustration is provided of a light amount ratio relative to an initial light amount of an OLED 201).

Further, note that a voltage droop having occurred in an LTPS-TFT is cancelled when a voltage lower than the predetermined voltage Vth continues to be applied as the voltage Vgs over a certain period of time. Further, the period of time required for the cancellation of voltage droop differs depending upon LTPS-TFT size. In the present embodiment, description is provided based on an example where the LTPS-TFTs have a size such that the period of time required for the cancellation of a voltage droop having occurred is no longer than one main scanning period.

(1-3-1) Structure of Controller 101

The following describes the main components of the controller 101.

Figure 9:
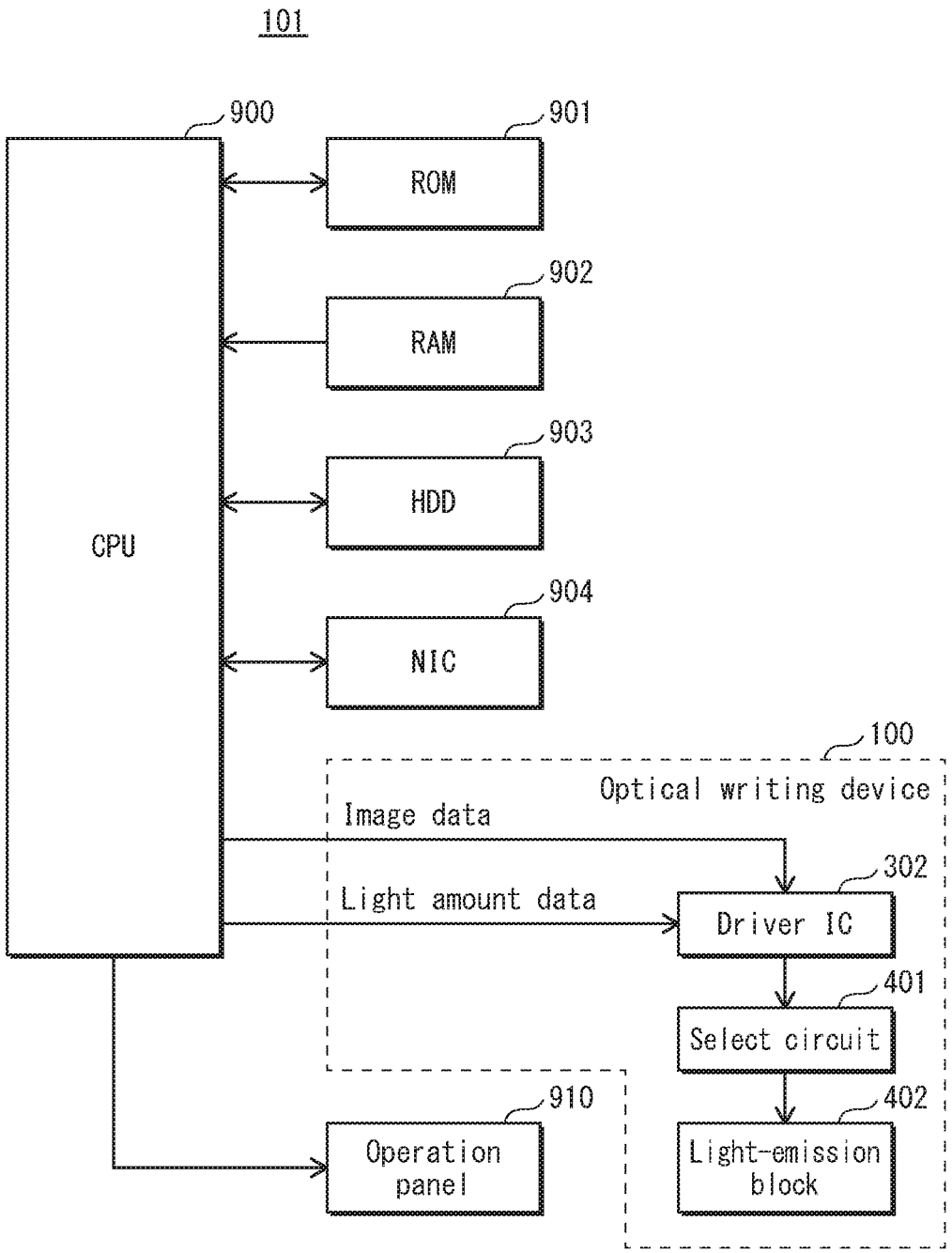
FIG. 9 illustrates main functional blocks of a controller 101.

As illustrated in FIG. 9, the controller 101 includes a central processing unit (CPU) 900, a read-only memory (ROM) 901, a random access memory (RAM) 902, a hard disk drive (HDD) 903, a network interface card (NIC) 904, and the operation panel 910. Every time the image forming device 1 is turned on, the CPU 900 is first reset, and then loads and runs a boot program stored in the ROM 901. Subsequently, the CPU 900 loads and runs a control program stored in the HDD 903 using the RAM 902 as a working storage.

The CPU 900 controls luminance signals by providing the driver IC 302 of the optical writing device 100 with image data and light amount data. The HDD 903, in addition to storing the control program, stores data such as print job data, image data, and an input value table that the controller 101 refers to for controlling luminance signals.

The NIC 904 communicates with other devices via a communication network such as a local area network (LAN) to receive print job data from devices external to the image forming device 1. The operation panel 910, as already described above, presents information to users of the image forming device 1, and receives input of instructions from users of the image forming device 1.

(1-3-2) Control of Luminance Signals

The following describes how luminance signals are controlled.

Figure 10:
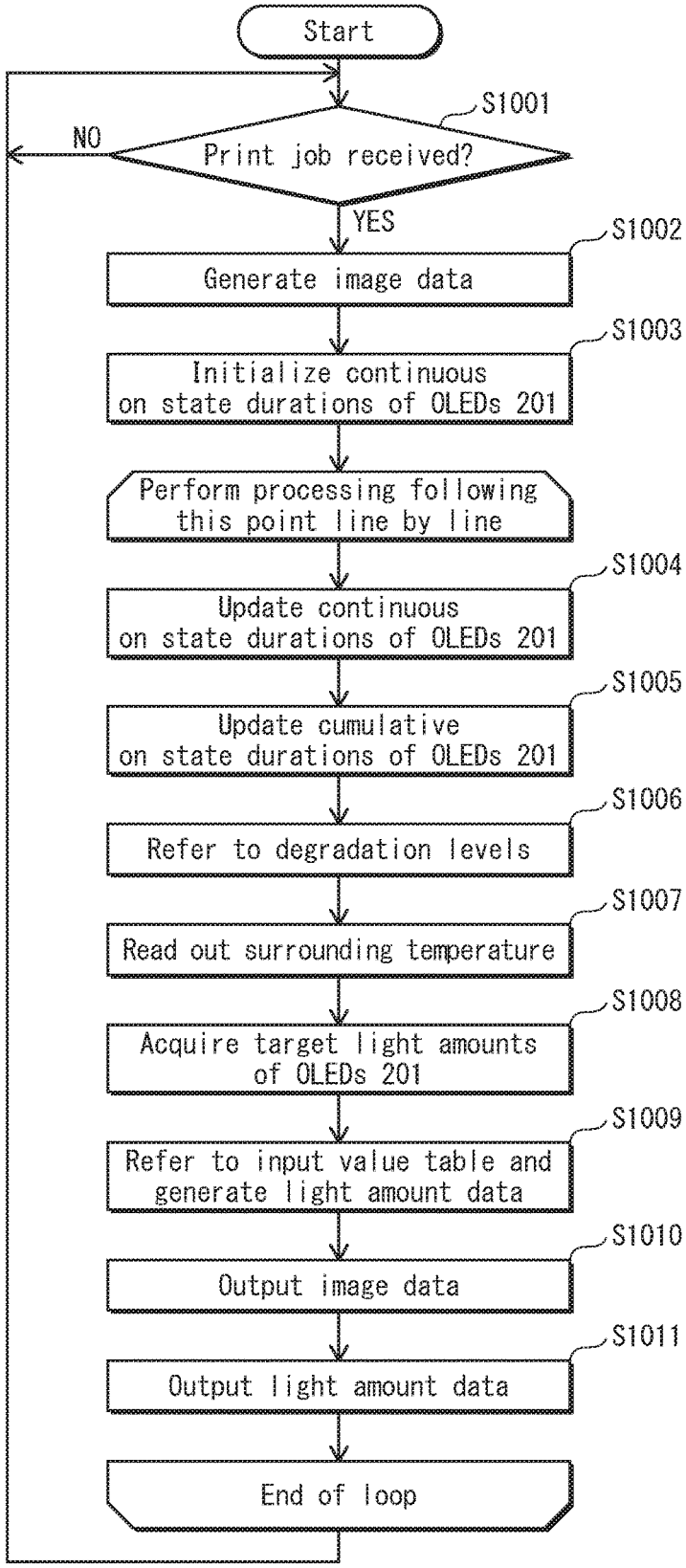
FIG. 10 is a flowchart illustrating control of luminance signals by the controller 101.

As illustrated in FIG. 10, the controller 101 first determines whether data for a print job has been received (Step S1001). Print job data includes description in a page description language (PDL), for example. Only when print job data has been received (YES in Step S1001), the controller 101 first analyzes the print job data to generate intermediate data, and then generates image data for each page of the print job by rasterizing the intermediate data (S1002). Subsequently, the controller 101 sets "0" as continuous on state durations of all OLEDs 201 (i.e., initializes the continuous on state durations of all OLEDs 201) (S1003).

In the present embodiment, a continuous on state duration of an OLED 201 is an emission history of the OLED 201, and specifically, indicates the number of consecutive lines for which the OLED 201 is kept in on state. Note that the continuous on state duration of an OLED 201 is measured page by page. That is, a continuous on state duration of an OLED 201 for the present page does not indicate whether or not the OLED 201 has been kept in on-state for a previous page.

Following the processing in Step S1003, the controller 101 performs the sequence of processing from Step S1004 to Step S1011 for each line of the image data.

First, the controller 101 updates the continuous on state durations of the OLEDs 201 (Step S1004). Specifically, in this processing, the controller 101 increments the continuous on state durations of OLEDs 201 that are to be put in on state in the processing-target line. Meanwhile, the controller 101 initializes (sets "0" as) the continuous on state durations of OLEDs 201 that are not to be put in on state in the processing-target line. The controller 101 stores the continuous on state durations of the OLEDs 201 to a continuous on state duration table such as that illustrated in FIG. 11A. The continuous on state duration table may be stored in the RAM 902, or may be stored in the HDD 903.

Subsequently, the controller 101 updates cumulative on state durations of the OLEDs 201 (Step S1005). Specifically, in this processing, the controller 101 increments the cumulative on state durations of OLEDs 201 that are to be put in on state in the processing-target line by one, while not changing the cumulative on state durations of OLEDs 201 that are not to be put in on state in the processing-target line. The controller 101 stores the cumulative on state durations of the OLEDs 201 to a cumulative on state duration table such as that illustrated in FIG. 11B. The cumulative on state duration table is stored in the HDD 903, which is a non-volatile storage. Upon shipment of the image forming device 1 from a factory, the cumulative on state durations of the OLEDs 201, stored in the cumulative on state duration table, all indicate "0".

Then, in Step S1006, the controller 101 calculates degradation levels of the OLEDs 201. The controller 101 calculates a degradation level of each OLED 201 by using the cumulative on state duration of the OLED 201 and by referring to a degradation level table, such as that illustrated in FIG. 11C. The degradation level table stores pairs of a cumulative on state duration and a degradation level. In the degradation level table, a degradation level is stored in the form of a light amount ratio of a light amount after elapse of a corresponding cumulative on state duration to an initial light amount. FIG. 8 exemplifies the relationship between the light amount ratio and the cumulative on state duration. The degradation level table may be stored in the ROM 901 or the HDD 903.

Note that when the degradation level table does not include a cumulative on state duration matching a cumulative on state duration calculated for an OLED 201 in Step S1005, the controller 101 may read out the closest one of the cumulative on state durations stored in the degradation level table and the degradation level associated thereto from the degradation level table, and may perform a calculation such as linear interpolation to acquire a degradation level corresponding to the cumulative on state duration calculated in Step S1005.

Further, instead of referring to such a degradation level table, the controller 101 may calculate a degradation level of an OLED 201 from a cumulative on state duration calculated in Step S1005 by using a mathematical formula indicating the relationship between cumulative on state durations and degradation levels.

Subsequently, the controller 101 acquires the surrounding temperature of the OLEDs 201 by referring to the temperature sensor 304 (S1007), and also acquires target light amounts of the OLEDs 201 by referring to a target light amount table such as that illustrated in FIG. 11D (S1008). As illustrated in FIG. 11D, the target light amount table stores a target light amount for every OLED 201. The target light amount table may be stored in the ROM 901 or the HDD 903.

Then, the controller 101 generates light amount data including a luminance signal value for each OLED 201 by referring to an input value table, such as that illustrated in FIG. 11E (Step S1009). As illustrated in FIG. 11E, the input value table is a table in which a luminance signal value is associated with each of a plurality of combinations of a continuous on state duration, a degradation level, a surrounding temperature, and a target light amount. The input value table may be stored in the ROM 901 or the HDD 903.

Needless to say, instead of referring to such an input value table, the controller 101 may calculate a luminance signal value for an OLED 201 by using a mathematical formula enabling calculation of a luminance signal value from a combination of a continuous on state duration, a degradation level, a surrounding temperature, and a target light amount of the OLED 201.

Subsequently, the controller 101 outputs the image data to the driver IC 302 (Step S1010), and then outputs the light amount data to the driver IC 302 (Step S1011). Receiving such data, the driver IC 302 specifies the OLEDs 201 that are to be put in on state in the processing-target line by referring to the image data, specifies luminance signal values for the specified OLEDs 201 by referring to the light amount data, and outputs luminance signals with the specified luminance signal values to the DACs 400 corresponding to the light-emission blocks 402 including the specified OLEDs 201.

The controller 101, when having executed the processing described above for every line of the image data, proceeds to Step S1001 to wait for another print job.

Figure 12:
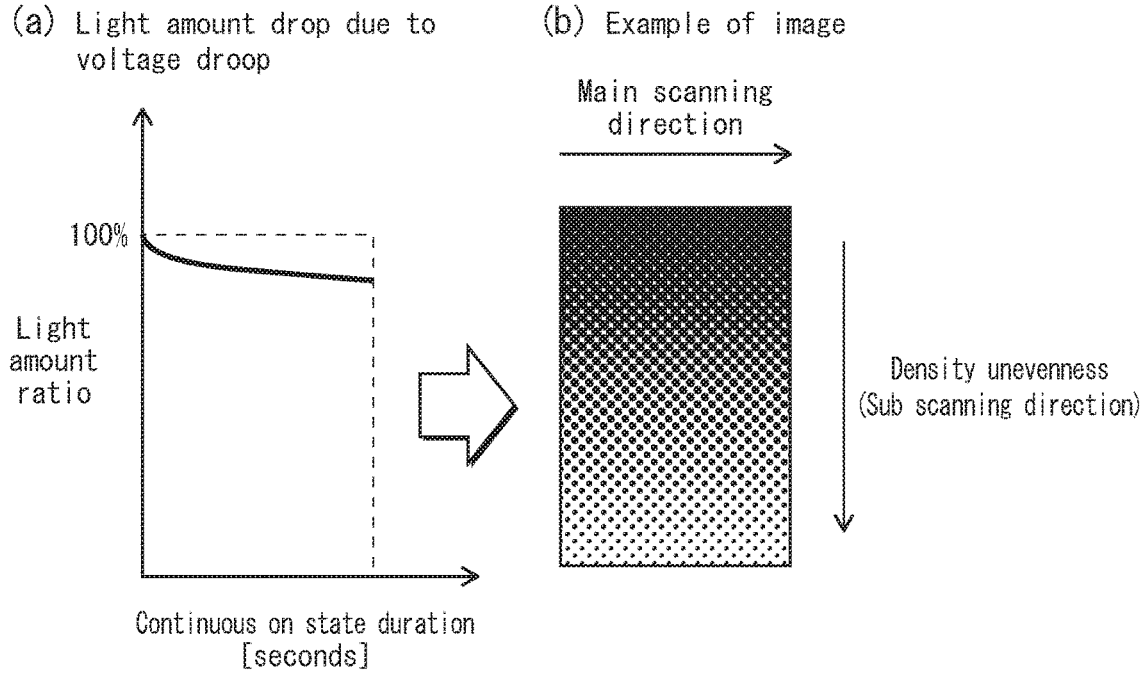
FIG. 12 includes portion (a) showing a graph illustrating a relationship between a continuous on state duration of the OLED 201 and a light amount ratio relative to an initial light amount of the OLED 201, referred to for explanation of the influence of a voltage droop occurring in a drive TFT 522, and portion (b) illustrating how density unevenness appears in a solid image.

FIG. 12 includes portion (a) illustrating a graph showing, for an OLED 201, an example of a relationship between a continuous on state duration of the OLED 201 and a light amount ratio of a light amount that the OLED 201 emits after being kept in on state to an initial light amount of the OLED 201, which is a light amount of the OLED 201 when the OLED 201 is put in on state after being kept in off state for a time period long enough to sufficiently cancel the effect of a voltage droop having occurred in a corresponding drive TFT 522. As illustrated in portion (a) of FIG. 12, the longer the continuous on state duration of the OLED 201, the greater the drop in light amount of the OLED 201 due to the voltage droop.

According to this, an OLED 201 can be caused to emit a constant light amount by controlling the luminance signal value for the OLED 201 so that the drive current supplied to the OLED 201 increases to compensate for the drop in light amount.

In the present embodiment, the input value table associates luminance signal values with continuous on state durations so that a light amount emitted by an OLED 201 does not decrease even if the OLED 201 is kept in on state for a long amount of time. Accordingly, even if a voltage droop occurs in a drive TFT 522 that supplies a drive current to the OLED 201 due to keeping the OLED 201 in on state, the OLED 201 can be caused to emit a desired light amount. Thus, the present embodiment achieves excellent print quality.

Further, the present embodiment eliminates the necessity of providing the optical writing circuit 100 with additional circuit components for suppressing density unevenness caused by voltage droops. As such, the present embodiment is applicable to optical writing devices with various structures without bringing about an increase in cost.

[2] Second Embodiment

The following describes a second embodiment of the technology pertaining to the present disclosure. An image forming device pertaining to the second embodiment has basically the same structure as the image forming device pertaining to the first embodiment. However, the image forming device pertaining to the second embodiment differs from the image forming device pertaining to the first embodiment for each drive TFT 522 having a size such that the time period required for canceling the influence of a voltage droop having occurred in a drive TFT 522 is equal to or longer than one main scanning period. The following mainly focuses on this difference between the embodiments. Note that in the present disclosure, components referred to in multiple embodiments are referred to by using the same reference symbols in every embodiment.

In the first embodiment, the light amount data is generated taking into consideration the continuous on state durations of the OLEDs 201, to compensate for a drop in light amounts of the OLEDs 201 occurring due to voltage droop. Meanwhile, in the present embodiment, light amount data is generated by using a state index value K for each OLED 201. A state index value for an OLED 201 indicates a continuous emission/non-emission state of the OLED 201. Note that in the present embodiment, the continuous emission/non-emission state of an OLED 201 is an emission/non-emission history of the OLED 201 of not only a duration for which the OLED 201 is kept in on state but also a duration for which the OLED 201 is kept in off state.

Figure 13:
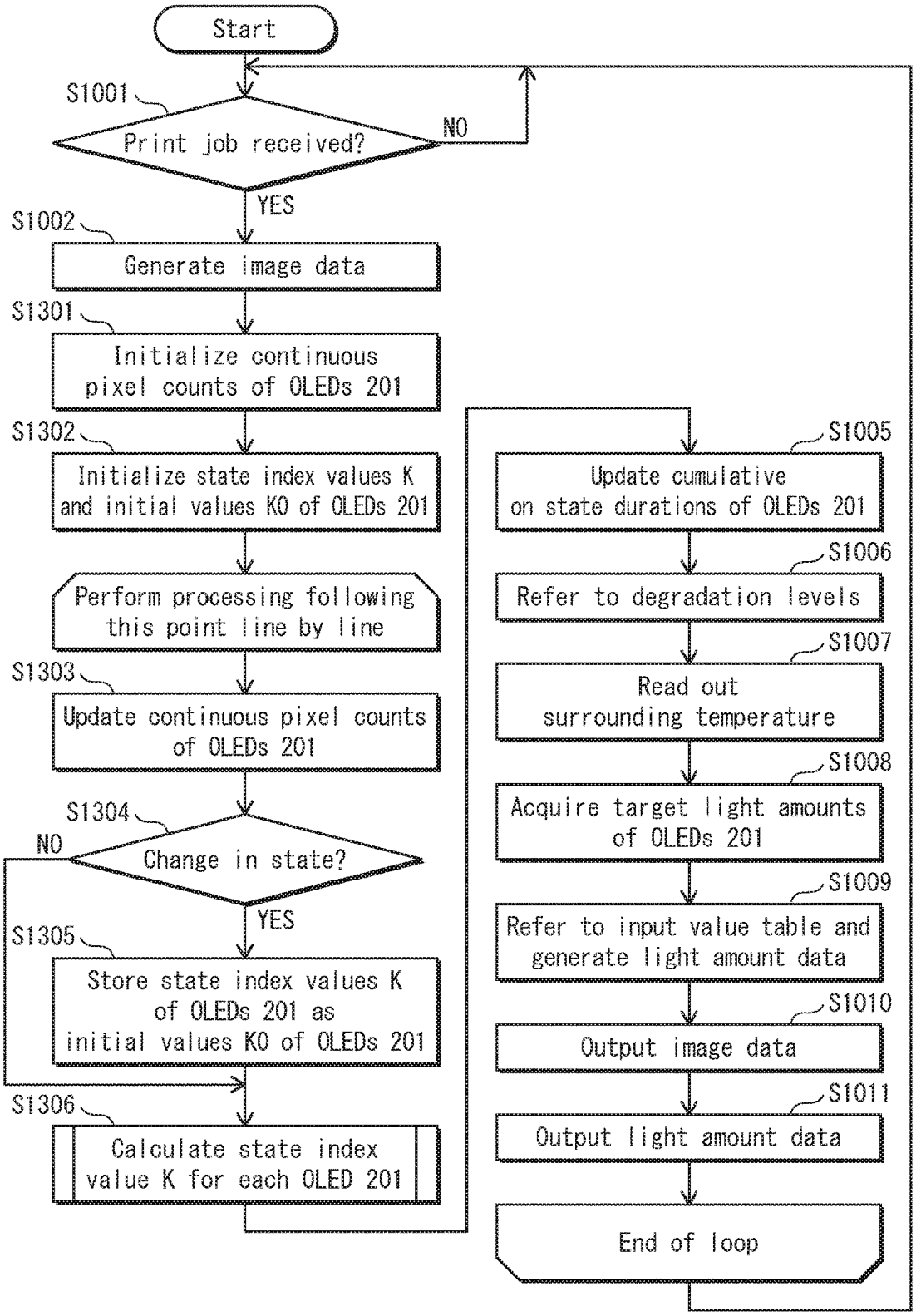
FIG. 13 is a flowchart illustrating control of luminance signals by the controller 101 in a second embodiment.

In the present embodiment, the controller 101 performs processing as illustrated in FIG. 13. Specifically, the controller 101, when receiving a print job (YES in Step S1001), first generates image data for the print job (S1002). Then, the controller 101 sets "0" as continuous pixel counts of all OLEDs 201 (i.e., initializes the continuous pixel counts) (S1301), and then sets "0" as the state index values K of all OLEDs 201 and also sets "0" as initial values K0 of all OLEDs 201. Here, a continuous pixel count of an OLED 201 indicates the number of consecutive pixels for which the OLED 201 is kept in on state or the number of consecutive pixels for which the OLED 201 is kept in off state.

For example, when an OLED 201 has been kept in on state for the first to third lines of the image data, the continuous pixel count for the OLED 201 is "3". Further, when an OLED 201 has been kept in off state for the first to fifth lines of the image data, the continuous pixel count for the OLED 201 is "5". However, when this OLED 201 is then put in on state for the sixth line of the image data, the continuous pixel count for the OLED 201 changes to "1".

Following the processing in Step S1302, the controller 101 performs the sequence of processing from Step S1303 to Step S1011 in FIG. 13 for each line of the image data.

Specifically, the controller 101 updates the continuous pixel counts of the OLEDs 201 (Step S1303). The continuous pixel counts of the OLEDs 201 are stored to a continuous pixel count table such as that illustrated in FIG. 14A. For example, in the continuous pixel count table, a continuous pixel count for an OLED 201 that is to be put in on state for the processing-target line is indicated by using a positive number, whereas a continuous pixel count for an OLED 201 that is to be put in off state for the processing-target line is indicated by using a negative number. For example, for an OLED 201 that is kept in on state for ten lines, the continuous pixel count column includes a positive value "10", whereas for an OLED 201 that is kept in off state for seventeen lines, the continuous pixel count column includes a negative value "−17". The continuous pixel count table may be stored in the RAM 902 or the HDD 903.

Subsequently, the controller 101 determines whether or not the state of any of the OLEDs 201 changes between the previous line and the processing-target line (i.e., whether or not any of the OLEDs 201 is to be put in on state from off state or is to be put in off state from of state) (S1304). When the state of at least one of the OLEDs 201 changes (YES in Step S1304), the controller 101 refers to a state index value table such as that illustrated in FIG. 14B, and for each OLED 201 whose state changes, copies the value in the state index value column to the initial value column (S1305). As illustrated in FIG. 14B, the state index value table includes, for each OLED 201, a state index value K and an initial value K0. The state index value table may be stored in the RAM 902 or in the HDD 903.

Figure 15:
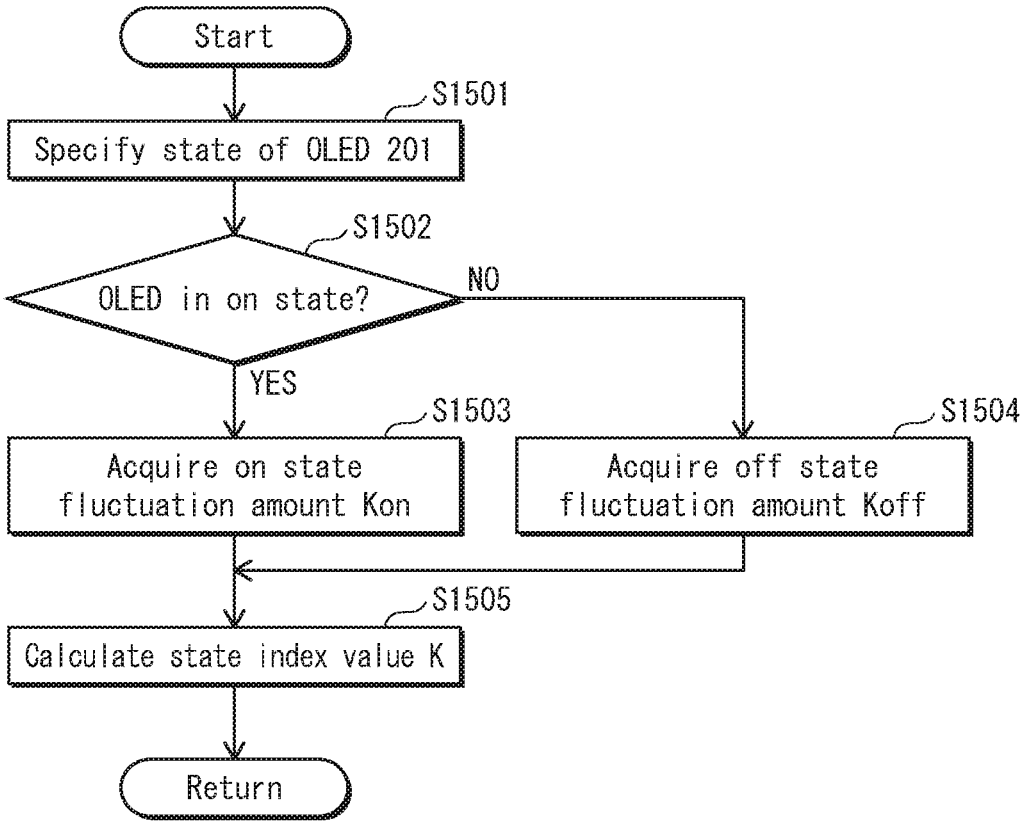
FIG. 15 is a flowchart illustrating processing in Step S1306 of calculating a state index value K for each OLED 201.

Then, in Step S1306, the controller 101 calculates state index values K of the OLEDs 201 by executing the processing illustrated in FIG. 15. Specifically, for each OLED 201, the controller 101 specifies whether the OLED 201 is to be put in on state or off state for the processing-target line by referring to the image data (S1501). Subsequently, the controller 101 determines whether the OLED 201 is to be put in on state for the processing-target line (S1502). When the OLED 201 is to be put in on state for the processing target line (YES in Step S1502), the controller 101 reads out an on state fluctuation amount Kon from a fluctuation amount table such as that illustrated in FIG. 14C, by referring to a value in an on state fluctuation amount column corresponding to the continuous pixel count of the OLED 201 (S1503).

Figure 16A:
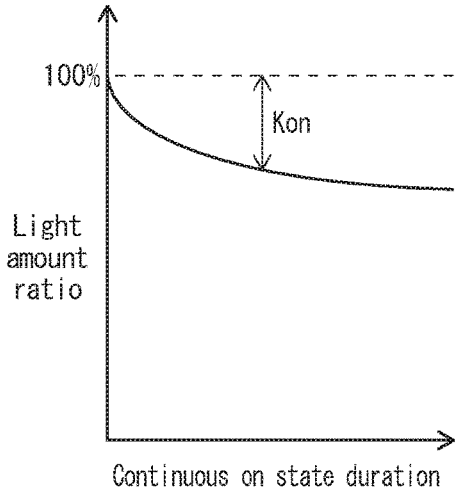
FIG. 16A shows a graph illustrating a change in the light amount ratio occurring when the OLED 201 is kept in on state, referred to for explanation of the influence of the voltage droop in the drive TFT 522.

As illustrated in FIG. 14C, the fluctuation amount table is a table associating a plurality of continuous pixel counts each with an on state fluctuation amount Kon and an off state fluctuation amount Koff. The fluctuation amount table may be stored in the ROM 901 or the HDD 903. Further, as illustrated in FIG. 16A, an on state fluctuation amount indicates a difference between the initial light amount and a light amount after an OLED 201 is kept in on state for the corresponding continuous pixel count.

Figure 16B:
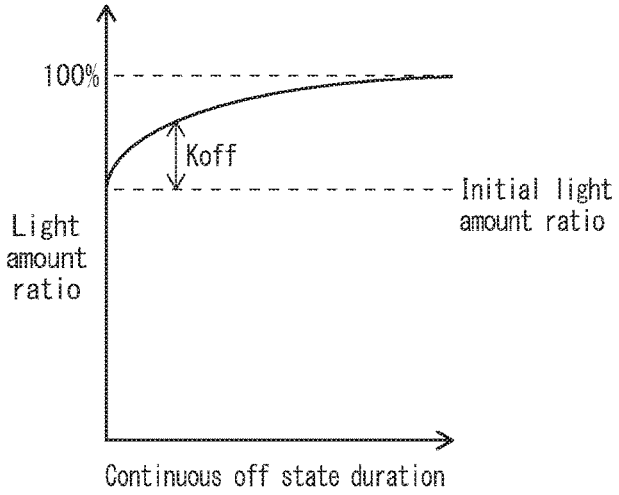
FIG. 16B shows a graph illustrating a change in the light amount ratio occurring when the OLED 201 is kept in off state.

Meanwhile, as illustrated in FIG. 16B, an off state fluctuation amount Koff indicates a difference between the initial light amount and a light amount after an OLED 201 is kept in off state for the corresponding continuous pixel count. In addition, an initial value K0 indicates either an initial light amount ratio of an OLED 201 when the OLED 201 is put in on state from off state or an initial light amount ratio of an OLED 201 when the OLED 201 is put in off state from on state.

Figure 16C:
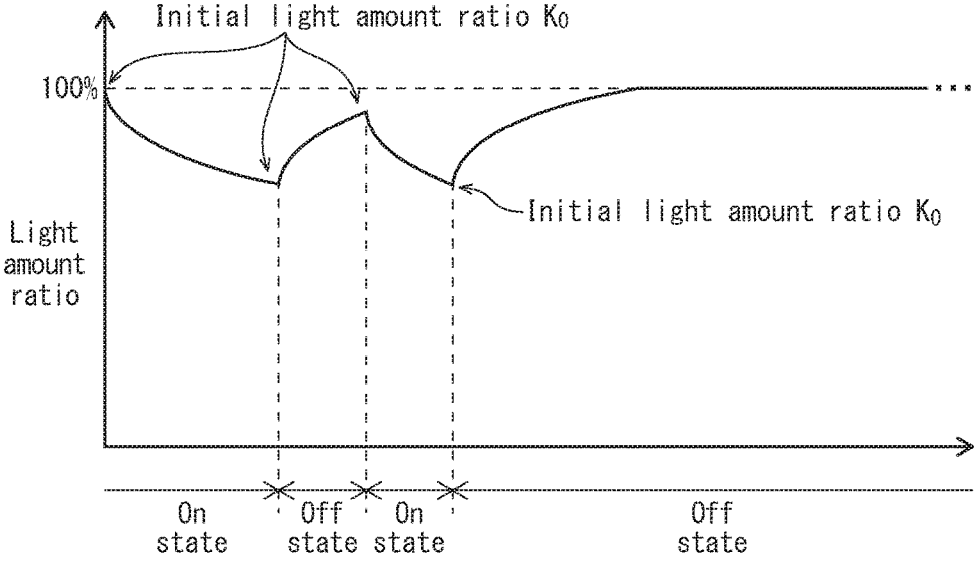
FIG. 16C shows a graph illustrating an example of a change in the light amount ratio.

FIG. 16C illustrates the increase and decrease in light amount occurring during image forming. The increase and decrease occur based on the characteristics illustrated in FIGS. 16A and 16B. Note that in FIG. 16C, a light amount of an OLED 201 at a given point while the OLED 201 is in off state indicates the light amount when the OLED 201 is put in on state at the point.

Subsequently, the controller 101 calculates a state index value K based on the initial value K0 and the lighting fluctuation amount Kon, by using the following formula (S1505).

[Math. 1]

State index value K=Initial value K0+On state fluctuation amount Kon

Meanwhile, when the OLED 201 is to be put in off state (NO in Step S1502), the controller 101 reads out a value in an off state fluctuation amount column corresponding to the continuous pixel count of the OLED 201 from the fluctuation amount table (S1504), and calculates a state index value K by using the following formula (S1505).

[Math. 2]

State index K=Initial value K0−Off state fluctuation amount Koff

Note that whenever a negative value is obtained as a result of the calculation using [Math. 2], zero is set as the state index value K. This is since, even if an OLED 201 is kept in off state for a long amount of time, the light amount of the OLED 201 does not become greater than the light amount at the start of image forming. After the calculation of the state index value K, processing returns to the superordinate processing illustrated in FIG. 13.

The processing following this point is similar to that in the first embodiment. That is, the controller 101 executes the processing between Steps S1005 and Step S1008, and then specifies luminance signal values by referring to the input value table (S1009). In this embodiment, an input value table such as that illustrated in FIG. 14D is used, which includes state index values K in place of the continuous on state durations included in the input value table in the first embodiment.

Subsequently, the controller 101 inputs the image data to the driver IC 302 (Step S1010), and then inputs the light amount data to the driver IC 302 (Step S1011). Accordingly, even when an OLED 201 is put in on state after being in the off state (i.e., while the cancellation of a voltage droop is underway), the OLED 201 is capable of emitting a desired amount of light.

[3] Third Embodiment

The following describes a third embodiment of the technology pertaining to the present disclosure. An image forming device pertaining to the third embodiment has basically the same structure as the image forming devices pertaining to the first and second embodiments. However, the image forming device pertaining to the third embodiment differs from the image forming devices pertaining to the first and second embodiments in terms of the method employed in the generation of light amount data. The following mainly focuses on this difference between the embodiments.

Figure 17:
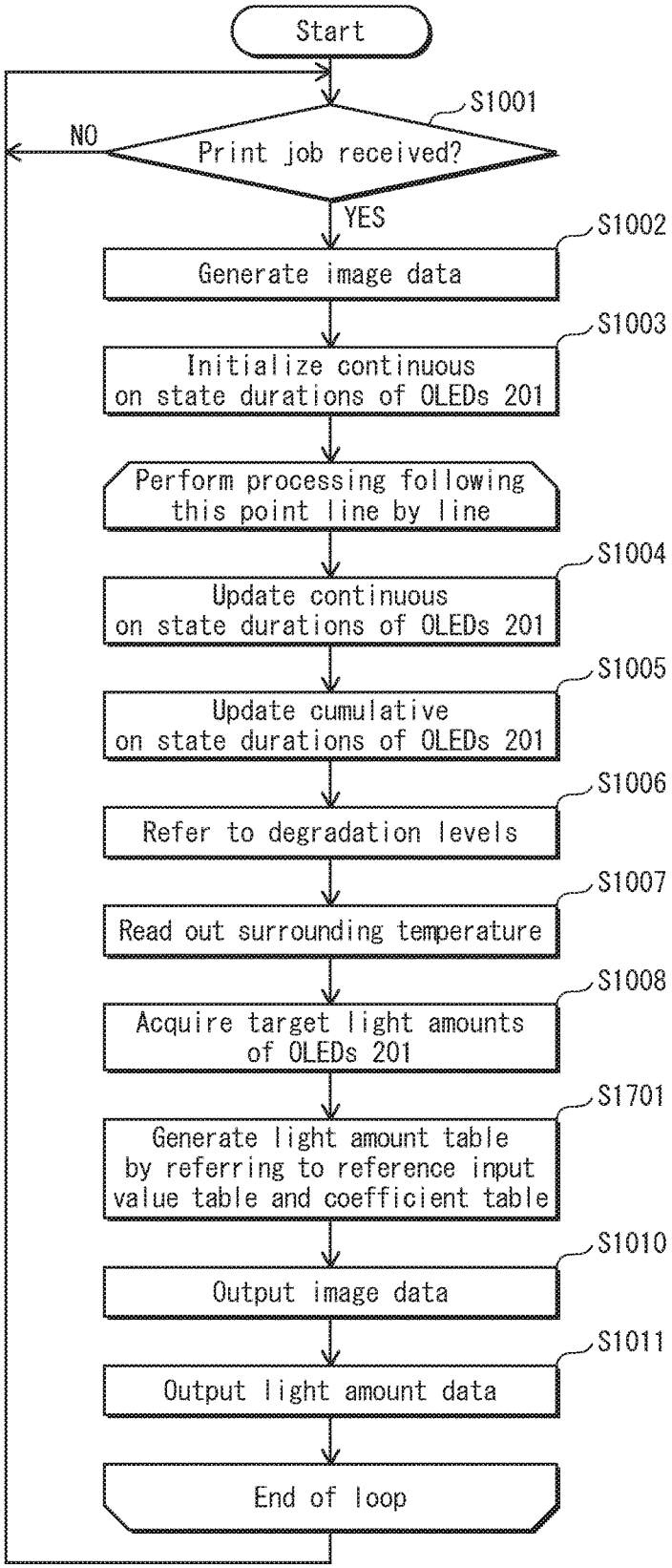
FIG. 17 is a flowchart illustrating control of luminance signals by the controller 101 in a third embodiment.

In the present embodiment, the controller 101 generates light amount data by referring to a reference input value table and a coefficient table, as indicated by Step S1701 in FIG. 17. FIG. 18A illustrates one example of the reference input value table. The reference input value table is a table associating each of a plurality of target light amounts with a reference luminance signal value. Meanwhile, FIG. 18B illustrates one example of the coefficient table. The coefficient table is a table associating each of a plurality of combinations of a continuous on state duration, a surrounding temperature, and a degradation level, or OLEDs 201, with a coefficient value.

In the generation of light amount data, the controller 101 first reads out, from the coefficient table, a coefficient value corresponding to the combination of the continuous on state duration of the OLED 201, the surrounding temperature acquired by the temperature sensor 304, and the degradation level of the OLED 201 acquired in Step S1006. Further, the controller 101 reads out, from the reference input value table, a reference luminance signal value corresponding to the target light amount of the OLED 201 acquired in Step S1008.

Then the controller 101 multiplies the reference luminance signal value and the coefficient value having been read out, and sets the value acquired as a result of the calculation as the luminance signal value for the OLED 201.

This configuration reduces the data amount of the tables to be referred for the generation of light amount data.

[Modifications]

Up to this point, the technology pertaining to the present disclosure has been described based on specific embodiments thereof. Needless to say, however, the technology pertaining to the present disclosure should not be construed as being limited to such embodiments, and various modifications including those described in the following can be made without departing from the spirit and scope of the technology pertaining to the present disclosure.

(1) In the embodiments, description is provided based on an example where the controller 101 updates continuous on state durations of OLEDs line by line.

However, the controller 101 need not acquire continuous on state durations of OLEDs 201 in such a manner, and instead, may use the page image data generated through the rasterizing and count, for each main scanning direction position (i.e., for each OLED 201), the number of pixels in the sub scanning direction for which the OLED 201 is to be put in on state.

(2) In the embodiments, description is provided based on an example where OLEDs 201 serve as light-emitting elements. However, the technology pertaining to the present disclosure achieves its effects when applied to any light-emitting element that drives upon receiving a drive current from an LTPS-TFT, and thus to the problem of density unevenness arises when a voltage droop occurs in the LTPS-TFT.

(3) In the embodiments, description is provided based on an example were drive TFTs 522 serve as LTPS-TFTs. However, the technology pertaining to the present disclosure achieves its effects when applied to any optical writing device in which an OLED 201 drives upon receiving a drive current from a drive circuit, and a voltage droop occurs in the drive circuit when the drive circuit keeps the OLED 201 in on state.

(4) The embodiments describe examples where the image forming device 1 is a printer having the tandem system. However, the technology pertaining to the present invention need not be applied to an image forming device having the tandem system, and may be applied to a color printer or a monochrome printer not having the tandem system. Further, the technology pertaining to the present disclosure achieves its effects when applied to a copier including a scanner device, a facsimile device having a communication function, or a multi-function peripheral (MFP) having the functions of both a copier and a scanner.

[5] Conclusion

The structures and configurations pertaining to the embodiments achieve an optical writing device that includes a light-emitting element and a TFT and that suppresses a sub scanning direction density unevenness that otherwise occurs when the light-emitting element is kept in on state.

One aspect of the present disclosure is an optical writing device optical writing device, upon acquiring data for one image page, performing light-exposure of a photoreceptor based on the data to form an electrostatic latent image corresponding to the image page on the photoreceptor, the light-exposure performed line-by-line of the image page, the optical writing device including: a current-driven light-emitting element; a thin film transistor configured to supply the light-emitting element with a drive current based on a luminance signal to put the light-emitting element in an on state; and a controller configured to, for each line of the image page, correct a first value of the luminance signal to yield a second value of the luminance signal, and to supply the thin film transistor with the luminance signal at the second value, wherein the second value compensates for a light amount fluctuation of the light-emitting element that is dependent upon an emission/non-emission history, from an initial line of the image page to the line, of a first continuous period where the light-emitting element is kept in the on state and a second continuous period where the light-emitting period is kept in an off state.

In the optical writing device, the controller preferably specifies the emission/non-emission history by referring to the data.

In the optical writing device, the emission/non-emission history preferably indicates a duration of a first continuous period that continues up to the line.

In the optical writing device, the emission/non-emission history preferably indicates a timing and a duration of a first continuous period and a timing and a duration of a second continuous period.

Preferably, the optical writing device further includes: a temperature detector configured to detect a surrounding temperature of the light-emitting element; and a degradation level detector configured to detect a degradation level of the light-emitting element, the degradation level dependent upon a total amount of time for which the light-emitting element is in the on state, wherein the second value, in addition to compensating for the light amount fluctuation dependent upon the emission/non-emission history, compensates for a light amount fluctuation dependent upon surrounding temperature and degradation level.

Preferably, the optical writing device further includes a table storing candidates of a correction value to be applied to the first value of the luminance signal to yield the second value of the luminance signal, the candidates each associated with a combination of an emission/non-emission history, a surrounding temperature, and a degradation level, wherein the controller corrects the first value of the luminance signal to yield the second value of the luminance signal by using one of the candidates corresponding to a combination of the emission/non-emission history, the surrounding temperature, and the degradation level of the light-emitting element.

Preferably, the optical writing device further includes: a temperature detector configured to detect a surrounding temperature of the light-emitting element; a degradation level detector configured to detect a degradation level of the light-emitting element, the degradation level dependent upon a total amount of time for which the light-emitting element is in the on state; a first storage configured to store a value of the luminance signal achieving a target light amount when the light-emitting element is in initial state; and a second storage configured to store coefficients each corresponding to a combination of an emission/non-emission history, a surrounding temperature, and a degradation level, each of the coefficients, when applied to the value of the luminance signal achieving the target light amount when the light-emitting element is in the initial state, yielding a value of the luminance signal achieving the target light amount for the corresponding combination of an emission/non-emission history, a surrounding temperature, and a degradation level, wherein the controller (i) acquires, from the first storage, the value of the luminance signal achieving the target light amount when the light-emitting element is in the initial state, (ii) acquires, from the second storage, one of the coefficients corresponding to a combination of the emission/non-emission history, the surrounding temperature, and the degradation level of the light-emitting element, and (iii) corrects the value of the luminance signal achieving the target light amount when the light-emitting element is in the initial state by using the acquired coefficient to yield the second value of the luminance signal.

In the optical writing device, the thin film transistor preferably contains low-temperature polycrystalline silicon (LTPS).

Another aspect of the present disclosure is an image forming device including an optical writing device that, upon acquiring data for one image page, performs light-exposure of a photoreceptor based on the data to form an electrostatic latent image corresponding to the image page on the photoreceptor, the light-exposure performed line-by-line of the image page, the optical writing device including: a current-driven light-emitting element; a thin film transistor configured to supply the light-emitting element with a drive current based on a luminance signal to put the light-emitting element in an on state; and a controller configured to, for each line of the image page, correct a first value of the luminance signal to yield a second value of the luminance signal, and to supply the thin film transistor with the luminance signal at the second value, wherein the second value compensates for a light amount fluctuation of the light-emitting element that is dependent upon an emission/non-emission history, from an initial line of the image page to the line, of a first continuous period where the light-emitting element is kept in the on state and a second continuous period where the light-emitting period is kept in an off state.

Although the technology pertaining to the present disclosure has been fully described by way of examples with reference to the accompanying drawings, it is to be noted that various changes and modifications will be apparent to those skilled in the art. Therefore, unless otherwise such changes and modifications depart from the scope of the technology pertaining to the present disclosure, they should be construed as being included therein.

What is claimed is:

1. An optical writing device which, upon acquiring image data for one image page, performs light-exposure of a photoreceptor based on the image data to form an electrostatic latent image corresponding to the image page on the photoreceptor, the light-exposure being performed line-by-line of the image page, and the optical writing device comprising:

a current-driven light-emitting element;

a thin film transistor configured to supply the light-emitting element with a drive current based on a luminance signal to put the light-emitting element in an on state; and a controller configured to, for each line of the image page, correct a first value of the luminance signal to yield a second value of the luminance signal, and to supply the thin film transistor with the luminance signal at the second value, wherein the second value compensates for a light amount fluctuation of the light-emitting element that is dependent upon a light emission/non-emission history, from a first line of the image page to a current processing-target line on the image page, wherein the light emission/non-emission history includes (i) a first continuous period in which the light-emitting element is kept in the on state over a number of consecutive lines of the image page, wherein the first continuous period is calculated page by page, and does not indicate whether the light-emitting element has been kept in the on state for a previous page, and (ii) a second continuous period in which the light-emitting period is kept in an off state over a number of consecutive lines, wherein the second continuous period is calculated page by page, and does not indicate whether the light-emitting element has been kept in the off state for a previous page, and wherein the second value further compensates for a degradation level of the light-emitting element, the degradation level corresponding to a total amount of time in which the light-emitting element is in the on state when image formation is performed over a plurality of pages.

2. The optical writing device of claim 1, wherein the controller specifies the light emission/non-emission history by referring to the image data.

3. The optical writing device of claim 1, wherein the light emission/non-emission history indicates a duration of the first continuous period that continues up to the current processing-target line.

4. The optical writing device of claim 2, wherein the light emission/non-emission history indicates a duration of the first continuous period that continues up to the current processing-target line.

5. The optical writing device of claim 1, wherein the light emission/non-emission history indicates a duration of the first continuous period and a duration of the second continuous period.

6. The optical writing device of claim 2, wherein the light emission/non-emission history indicates a duration of the first continuous period, and a duration of the second continuous period.

7. The optical writing device of claim 1, further comprising:

a temperature detector which detects a surrounding temperature of the light-emitting element; and a degradation level detector which detects the degradation level of the light-emitting element, wherein the second value compensates for a light amount fluctuation dependent upon the surrounding temperature and the degradation level.

8. The optical writing device of claim 7, further comprising:

a table storing candidates of a correction value to be applied to the first value of the luminance signal to yield the second value of the luminance signal, the candidates each associated with a combination of the light emission/non-emission history, the surrounding temperature, and the degradation level, wherein the controller corrects the first value of the luminance signal to yield the second value of the luminance signal by using one of the candidates corresponding to a combination of the light emission/non-emission history, the surrounding temperature, and the degradation level of the light-emitting element.

9. The optical writing device of claim 1, further comprising:

a temperature detector which detects a surrounding temperature of the light-emitting element;

a degradation level detector which detects the degradation level of the light-emitting element;

a first storage which stores a value of the luminance signal achieving a target light amount when the light-emitting element is in initial state; and a second storage which stores coefficients each corresponding to a combination of the light emission/non-emission history, the surrounding temperature, and the degradation level, each of the coefficients, when applied to the value of the luminance signal achieving the target light amount when the light-emitting element is in the initial state, yielding a value of the luminance signal achieving the target light amount for the corresponding combination of the light emission/non-emission history, the surrounding temperature, and the degradation level, wherein the controller (i) acquires, from the first storage, the value of the luminance signal achieving the target light amount when the light-emitting element is in the initial state, (ii) acquires, from the second storage, one of the coefficients corresponding to a combination of the light emission/non-emission history, the surrounding temperature, and the degradation level of the light-emitting element, and (iii) corrects the value of the luminance signal achieving the target light amount when the light-emitting element is in the initial state by using the acquired coefficient to yield the second value of the luminance signal.

10. The optical writing device of claim 1, wherein the thin film transistor contains low-temperature polycrystalline silicon (LTPS).

11. An image forming device comprising the optical writing device of claim 1.

* * * * *